US006098822A

United States Patent [19]

Wohlford

[11] Patent Number: 6,098,822

[45] Date of Patent: Aug. 8, 2000

[54] SHELVING SYSTEM

[75] Inventor: James G. Wohlford, Minneapolis, Minn.

[73] Assignee: Decade Industries, Inc., Arden Hills, Minn.

[21] Appl. No.: 09/305,262

[22] Filed: May 4, 1999

[51] Int. Cl.[7] ..... A47B 43/00

[52] U.S. Cl. ..... 211/186

[58] Field of Search ..... 211/186, 134, 211/153, 90.01, 90.04, 119.003, 119.005

[56] References Cited

U.S. PATENT DOCUMENTS

| | | |
|---|---|---|
| 3,554,456 | 1/1971 | Moore . |
| 4,315,466 | 2/1982 | Boerigter . |
| 4,374,497 | 2/1983 | Harmand . |
| 4,711,184 | 12/1987 | Wallin et al. . |
| 4,898,103 | 2/1990 | Pontoppidan et al. . |
| 5,197,393 | 3/1993 | Yeakle . |
| 5,553,550 | 9/1996 | Doyle . |
| 5,752,449 | 5/1998 | Simon et al. . |
| 5,938,367 | 8/1999 | Olson . |
| 5,950,846 | 9/1999 | Duane . |

*Primary Examiner*—Alvin Chin-Shue
*Assistant Examiner*—Sarah Purol
*Attorney, Agent, or Firm*—Kinney & Lange, P.A.

[57] ABSTRACT

A shelf isolation and support system comprising a plurality of studs and a plurality of cavities, each of the cavities having therein a piston and a damping material. The plurality of studs are capable of supporting a shelf with respect to a frame. Each of the studs is aligned with an open end of one of the plurality of cavities. The piston located within the cavity contacts an end of the respective studs. The damping material located within the cavity damps movement of the piston.

23 Claims, 4 Drawing Sheets

SHELVING SYSTEM

BACKGROUND OF THE INVENTION

The present invention pertains to protecting electronic appliances such as stereo equipment from vibration or resonance. More particularly, the invention pertains to a shelving system.

Performance of electronic audio and video equipment can be significantly affected by slight vibrational movement or resonance. This is especially true in high performance electronic audio and video equipment where even slight vibration or resonance detracts from their output. Electronic audio and video equipment can include stereo equipment, such as compact disc players, turntables, tape decks, or receivers, as well as televisions and speakers.

Electronic audio and video equipment is generally located or placed on some type of shelving unit or cabinet. The shelving unit or cabinet itself can become the source of vibration or resonance which affects the performance of the electronic equipment. The shelving or cabinet can also pick up or transfer vibration or resonance to the electronic equipment and adversely affect the output of the appliance. Vibration or resonance can be created by walking near the unit, sound waves from subwoofer speakers, jarring the shelving unit, or some other source.

Electronic audio and video equipment has previously been isolated or protected from vibration or resonance by supporting the shelving units or cabinets that the equipment is set upon with the pointed ends of a set of spikes. The ends or points of the spikes are used to contact and support individual shelves. By using the ends of the spikes to contact the shelves, the surface area of the contact point between the spike and the shelf is minimized. Minimizing the surface area of the contact point limits or minimizes the level or amount of vibration or resonance transferred to the shelf and ultimately to the piece of electronic equipment.

The spikes themselves, however, do not filter or isolate the equipment from all vibration or resonance. Rather, use of the pointed ends of the spikes significantly decreases the vibration or resonance associated with low bass signals, or signals below approximately 100 Hz, from being transferred to the piece of electronic equipment. Thus, some vibration or resonance is still transferred to the shelf and ultimately to the electronic equipment.

Further, supporting the shelves upon which the electronic equipment is set with the tips or ends of the spikes creates an unstable support system. In particular, individual shelves can easily slide laterally and ultimately fall off of the pointed spikes which are supposed to provide the shelves with support. This type of lateral movement to the shelves could be caused by bumping the shelving unit or moving a piece of electronic equipment on one shelf that is connected by wire to another piece of electronic equipment located somewhere else, such as on another shelf.

Thus, there is no system that properly isolates and provides a stable support for a piece of electronic audio or video equipment.

SUMMARY OF THE INVENTION

The invention is a device for providing a shelving system for electronic audio and video equipment. The device comprises a plurality of studs and a plurality of cavities, each of the cavities having therein a piston and a damping element. The plurality of studs support a shelf upon which individual pieces of electronic audio and video equipment are placed.

Each of the plurality of cavities has a single open end aligned with the studs. The piston is contained within the open end of the cavity and contacts an end of the stud. The damping element is located within the cavity to contact and damp movement of the piston.

DETAILED DESCRIPTION

Figure 1:
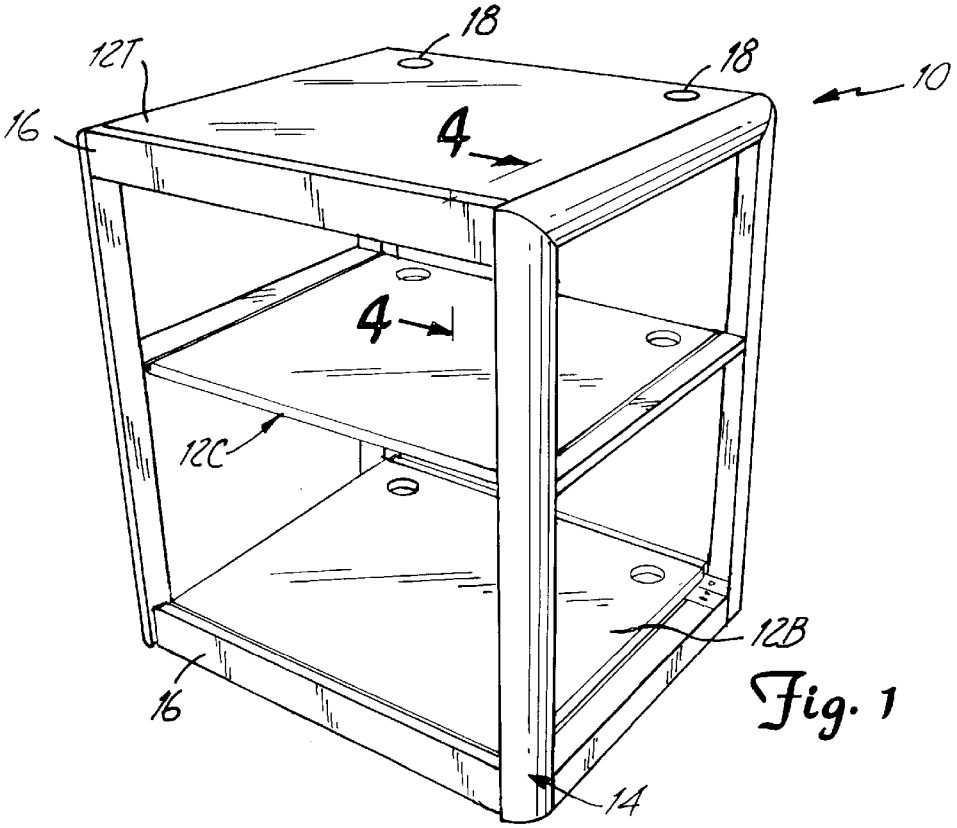
FIG. 1 is a perspective view of a preferred embodiment of the invention.

A preferred embodiment of a shelving system 10 is shown in FIG. 1. The shelving system 10 is comprised of three shelves, a top shelf 12T, a center shelf 12C and a bottom shelf 12B. The shelving system 10, however, could include more or fewer shelves than those depicted in FIG. 1. The shelves 12T, 12C and 12B are supported by a frame 14. A set of trim plates 16 can also be included and tailored to achieve a desired decorative effect to the shelving system 10. The trim plates 16 are secured to the frame 14.

The shelves 12T, 12C and 12B are used to support various pieces of electronic equipment such as televisions, turntables, amplifiers, outboard D/A convertors, surround sound processors, satellite receivers and CD or DVD players. A pair of passages 18 through each of the shelves 12T, 12C and 12B allow for wire connections to be made between multiple pieces of electronic equipment that are located on a different shelf or at some other location.

The shelves 12T, 12C and 12B are acoustically isolated from the frame 14 to maximize the performance of the electronic components they support. Acoustically isolating the shelves 12T, 12C and 12B from the frame 14 helps prevent vibration or resonance from being transferred to the shelves 12T, 12C and 12B and ultimately to the electronic equipment impairing its performance. The open architecture of the shelving system 10 also insures superior ventilation for the electronic equipment.

Figure 2:
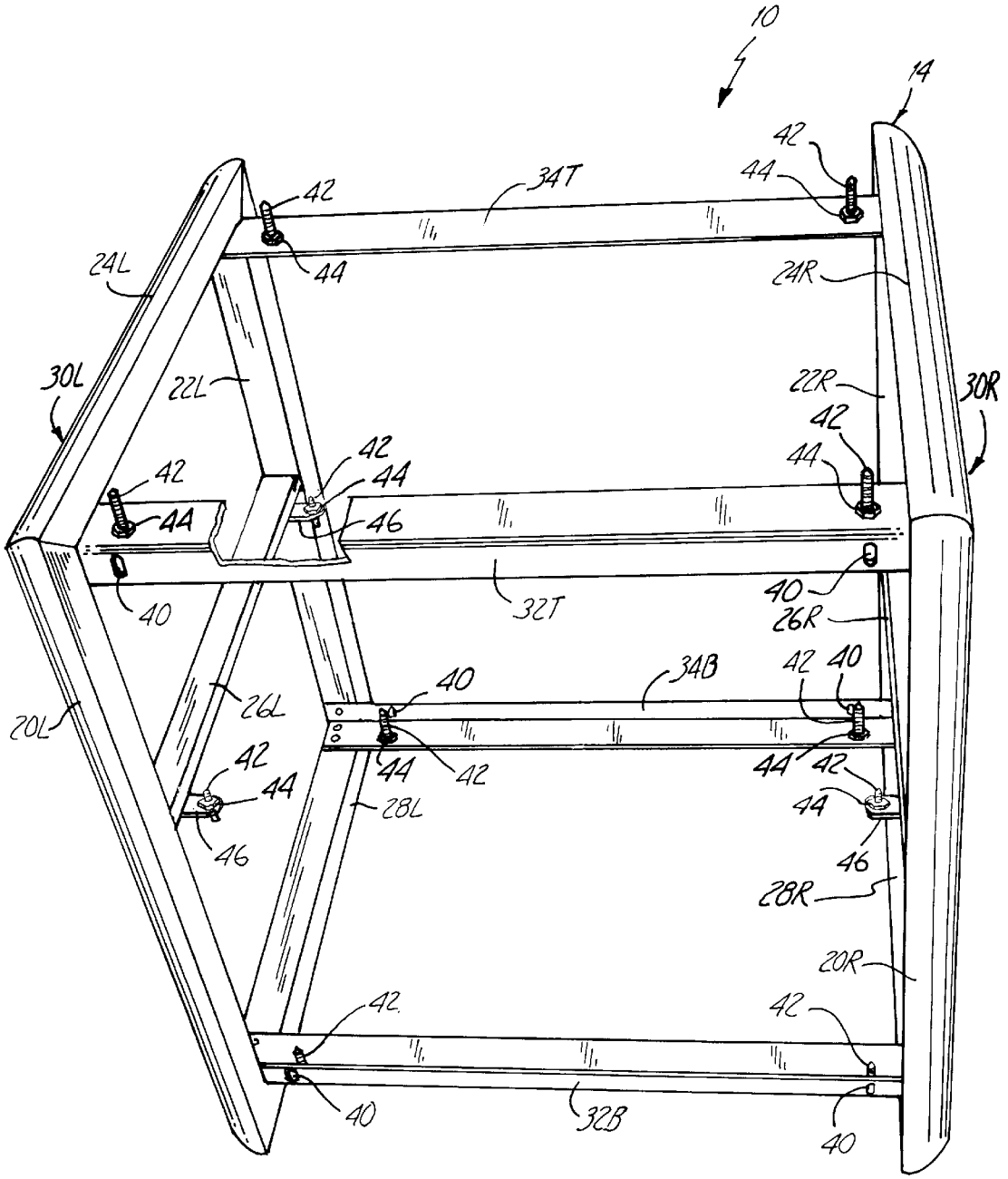
FIG. 2 is a perspective view of the preferred embodiment of the invention with a set of shelves and a set of trim plates removed.

FIG. 2 is a perspective view of the preferred embodiment of the shelving system 10 with the trim plates 16 and the shelves 12T, 12C and 12B removed. FIG. 2 allows a more clear view of the frame 14 and its component parts which support the shelves 12T, 12C and 12B.

As shown in FIG. 2, the frame 14 is constructed in part from a pair of front upright posts 20L and 20R and a pair of back upright posts 22L and 22R. The front upright post 20L is connected to the back upright post 22L by a top rail 24L, a center rail 26L and a bottom rail 28L, to create a left side member 30L. The front upright post 20R is similarly connected to the back upright post 22R by a top rail 24R, a center rail 26R and a bottom rail 28R to create a right side member 30R. The left side member 30L is connected to the right side member 30R by a series of crossbars, which include a front top crossbar 32T, a front bottom crossbar 32B, a back top crossbar 34T and a back bottom crossbar 34B. The crossbars 32T, 32B, 34T and 34B are preferably pieces of angle iron.

Front top crossbar 32T is mounted to the left side member 30L so that a right angle of the angle iron fits into an inside joint that is formed between the front upright post 20L and the top rail 24L. The front top crossbar 32T is similarly connected to the right side member 30R at an inside joint between the front upright post 20R and the top rail 24R. The other crossbars 32B, 34T and 34B are also similarly mounted with their respective right angles secured to inside joints of the side members 30L and 30R. The side members 30L and 30R are thus secured together to form the frame 14.

Mounting the crossbars 32T, 32B, 34T and 34B in this manner provides a vertical and a horizontal surface at each crossbar. The top crossbars 32T and 34T have a vertical surface which extends downward from a horizontal surface. The bottom crossbars 32B and 34B have a vertical surface which extends upward from a horizontal surface. The direction in which the vertical surfaces of the crossbars 32T, 32B, 34T and 34B extend is a natural consequence of the manner in which the angle iron, which is preferably used for the crossbars 32T, 32B, 34T and 34B, is mounted.

The vertical surfaces of the crossbars 32T, 32B, 34T and 34B provide a mounting surface for the trim plates 16. A slot 40 is placed on both the left and right sides of the vertical mounting surfaces of the crossbars 32T, 32B, 34T and 34B to secure the trim plates 16 to the frame 14. The slots 40 are preferably located on the crossbars 32T, 32B, 34T and 34B at the same position for standardization and interchangeability of the crossbars 32T, 32B, 34T and 34B and the trim plates 16.

The shelving system 10 further includes means by which the shelves 12T, 12C and 12B are supported. A plurality of studs 42 extend from the frame 14 to provide support for the shelves 12T, 12C and 12B. The stud 42 that extends from the right side of the top crossbar 32T will be discussed to illustrate the manner in which the studs 42 are secured to the frame 14.

Considering the right side of the top crossbar 32T, the stud 42 extends above the horizontal surface of the top crossbar 32T a sufficient distance so that the shelf 12T is supported by the stud 42 rather than resting on or contacting the horizontal surface of the top crossbar 32T. A locking nut 44 is threaded onto the stud 42 until it contacts the horizontal surface of the top crossbar 32T to maintain the desired position of the stud 42 relative to the top crossbar 32T.

The studs 42 are similarly connected to the horizontal surfaces on the left and right sides of the crossbars 32T, 32B, 34T and 34B as described for the right side of the top crossbar 32T. As a result of the manner in which the crossbars 32B and 34B are mounted to the inside joints of the side members 30L and 30R, the studs 42 extend upwards from the horizontal surface of the crossbars 32B and 34B similar to the vertical surfaces of the crossbars 32B and 34B. Conversely, the studs 42 are connected to the crossbars 32T and 34T so that they extend upwards from the horizontal surface opposite the direction of the vertical surfaces. The crossbars 32T, 32B, 34T and 34B thus provide one technique for securing the plurality of studs 42 that support the top and the bottom shelves 12T and 12B.

There are, however, no crossbars between the side members 30L and 30R that the studs 42 can be secured to for supporting the center shelf 12C. An alternative technique is therefore used to support the center shelf 12C. A factor in determining how to support the center shelf 12C is that the plurality of studs 42 are preferably secured to the frame 14 in vertical alignment. Thus, the stud 42 secured to the right comer of the top crossbar 32T is directly above the stud 42 secured to the right comer of the bottom crossbar 32B. Vertically aligning the plurality of studs 42 enables the shelves 12T, 12C and 12B to be standardized for construction purposes and for maintaining interchangeability.

Securing the studs 42 to the center rails 26L and 26R, similar to the manner in which the studs 42 are secured to the crossbars 32T, 32B, 34T and 34B, will not maintain vertical alignment of the plurality of studs 42. A tab 46 to which the stud 42 can be secured is therefore attached to or extended from the center rails 26L and 26R. This allows vertical alignment of the plurality of studs 42 to be maintained.

Considering the front left comer of the frame 14, the tab 46 is secured to the center rail 26L so that the stud 42 secured to the tab 46 is vertically aligned with the stud 42 secured to the left side of the top crossbar 32T and the bottom crossbar 32B. The stud 42 is secured to the tab 46 with the locking nut 44 in a manner similar to that used with respect to the studs 42 that are secured to the crossbars 32T, 32B, 34T and 34B. As illustrated in FIG. 2, the tab 46 extends from both the front and the back of the center rails 26L and 26R to maintain the vertical alignment of the plurality of studs 42 and to provide support to the center shelf 12C.

The tabs 46 are preferably attached to the center rails 26L and 26R rather than their being formed as part of the center rails 26L and 26R for ease of manufacturing. In a preferred embodiment, a top surface of the center rails 26L and 26R is flush with a top surface of the center shelf 12C when it is supported by the studs 42 secured to the tabs 46. This can be accomplished by including a downward vertical leg on the tab 46 or adjusting the height or thickness of the center rails 26L and 26R.

Figure 3:
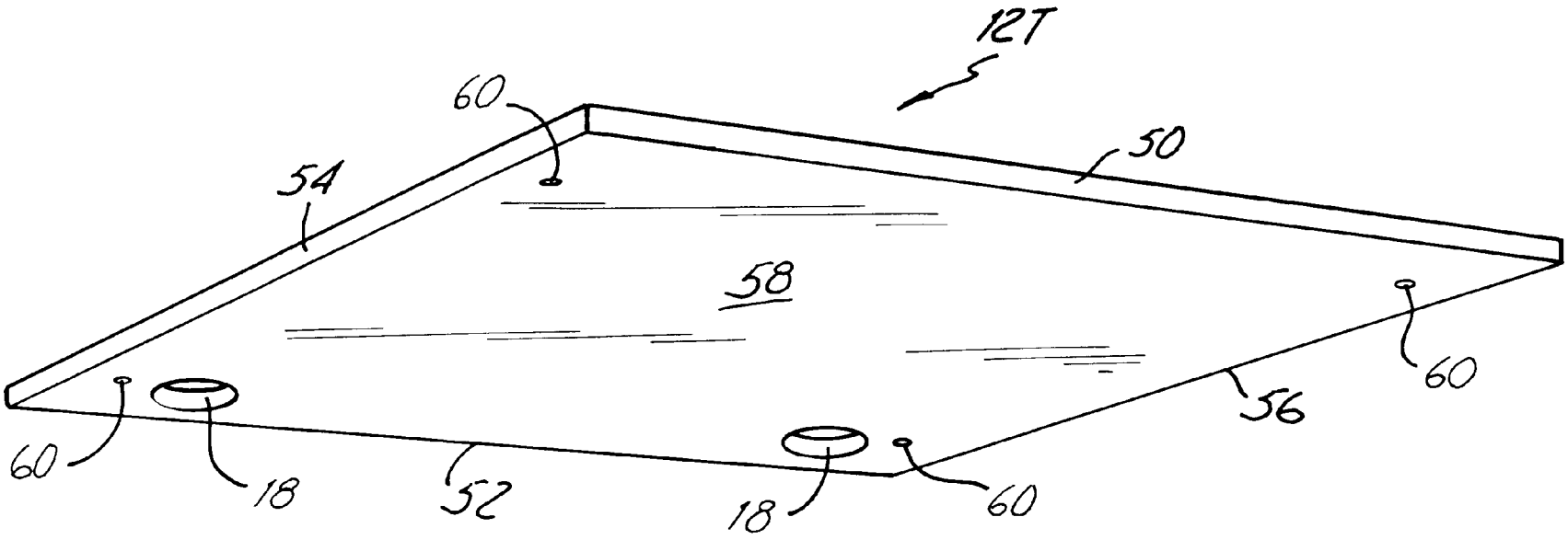
FIG. 3 is a perspective view from beneath a shelf that is used in the preferred embodiment of the invention.

FIG. 3 is a perspective view from below the top shelf 12T. The top shelf 12T includes a front vertical surface 50, a back vertical surface 52, a left vertical surface 54, and a right vertical surface 56. The top shelf 12T also includes a horizontal bottom surface 58. As previously explained, the pair of passages 18 through the shelf 12T are used to direct cables from electronic equipment placed on the shelf 12T to other locations. The bottom surface 58 of the shelf 12T, also has a plurality of cavities 60. The cavities 60 are positioned such that they are aligned with and receive the plurality of studs 42 which extend from the frame 14. The shelf 12T is thus set upon and supported by the studs 42 which are received into the cavities 60. Lateral movement of the shelf 12T with respect to the frame 14 is thus limited by the studs 42 being received within the cavities 60. The shelving system 10 thereby provides a more sturdy structure to support high performance electronic equipment.

Each of the other shelves 12C and 12B also have the plurality of cavities 60 bore into their respective bottom surfaces as well. Similarly, the plurality of cavities 60 bore into the bottom surfaces of the shelves 12C and 12B are aligned with and receive the plurality of studs 42 that extend from the frame 14. By maintaining vertical alignment of the plurality of studs 42, the plurality of cavities 60 bore into the bottom surfaces of the shelves 12T, 12C and 12B are standardized and the shelves 12T, 12C and 12B can be interchanged.

Figure 4:
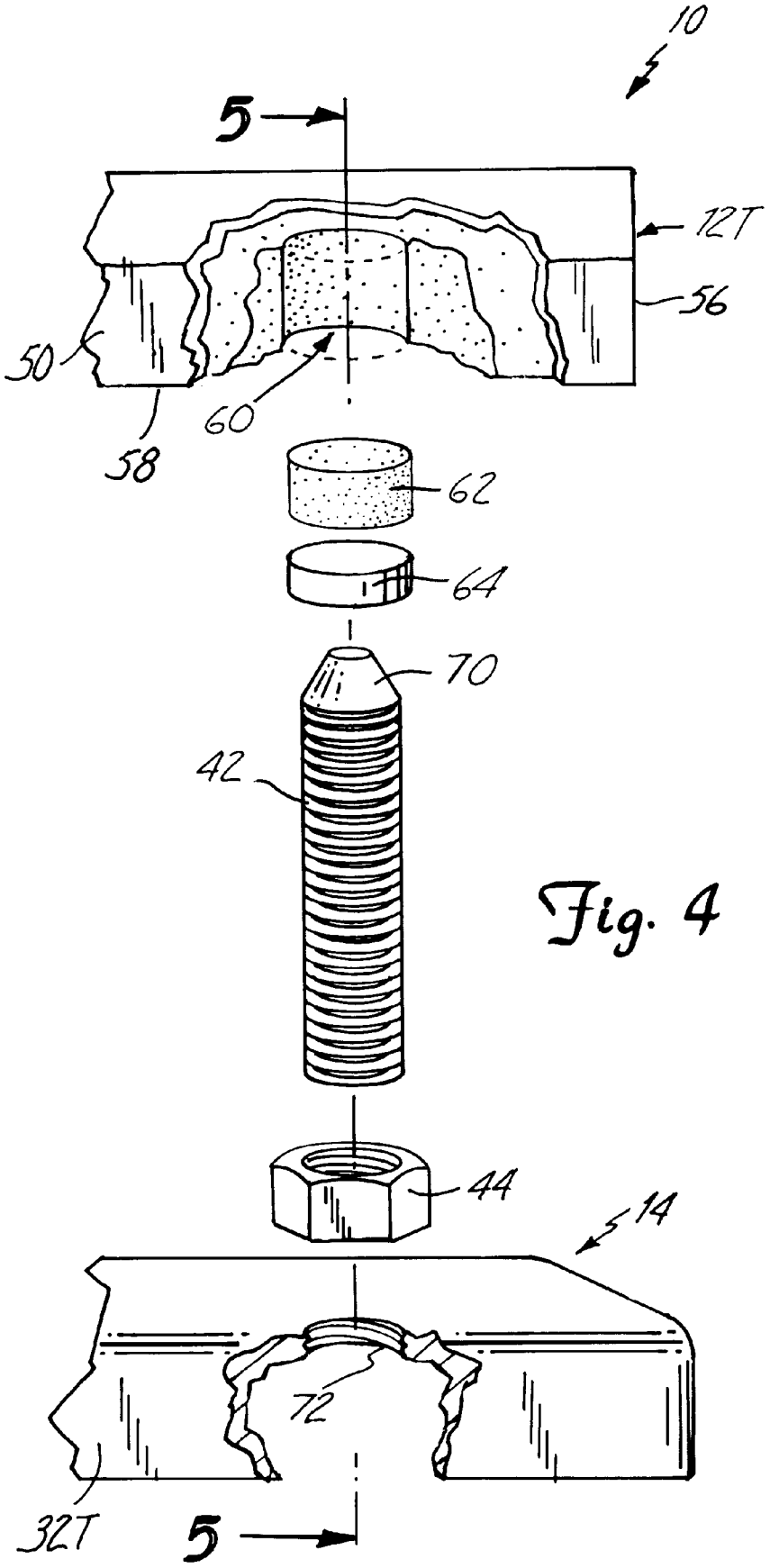
FIG. 4 is an exploded, partial sectional view along a section 4—4 of FIG. 1.

FIG. 4 is an exploded, partial sectional view of a preferred embodiment of the invention along section 4–4 of FIG. 1. FIG. 4 illustrates the right side of the top crossbar 32T which supports the top shelf 12T. FIG. 4 shows how the shelving system 10 acoustically isolates the shelf 12T from the frame 14. While the discussion corresponding to FIG. 4 refers to the shelf 12T, it similarly applies to the shelves 12C and 12B.

As shown in FIG. 4, the shelf 12T includes the cavity 60 bore in the bottom surface 58 nearest the corner between the vertical front surface 50 and the vertical right side surface 56. The cavity 60 is aligned with and receives the stud 42 secured to the right side of the top crossbar 32T.

Within the cavity 60 is placed a vibration damping material 62 that is captured within the cavity 60 by a piston 64. The vibration damping material 62 is preferably made of a spongy type of polymeric damping material produced by a variety of manufacturers. The vibration damping material 62 preferably measures approximately 3/16 inches thick and 3/8 inches in diameter. However, larger and smaller dimensions for the vibration damping material 62 can be substituted while maintaining suitable performance of the shelving system 10. The piston 64 is preferably made of nylon, metal or other suitable material. The piston 64 measures approximately 1/8 inch thick and 3/8 inches in diameter. Again, larger or smaller diameters for the piston 64 can be used. However, the diameter of the piston 64 should be similar to the diameter of the damping material 62, which is slightly less than the diameter of the cavity 60.

The shelf 12T is preferably made of Medium Density Fiber (MDF) board, although wood, particle board, plywood, glass, plastic or stone would be suitable alternative materials. MDF board is a special type of fiber or chip board designed to minimize or prevent vibration or resonance. The cavity 60 is bore through the bottom surface 58 of the MDF board functioning as the shelf 12T. The vibration damping material 62 is then captured within the cavity 60 by the piston 64.

The stud 42 is preferably threaded to allow adjustability and leveling and has a pointed tip 70. The stud 42 is threaded into a through hole 72 in the top crossbar 32T. The pointed tip 70 of the stud 42 extends upward beyond the top crossbar 32T in order to contact the piston 64. The distance the stud 42 extends beyond the top crossbar 32T is adjustable by an amount equal to the length of the stud 42. The distance that the stud 42 extends above the top crossbar 32T is adjusted to ensure that the shelf 12T is level and is not resting upon the top crossbar 32T. Once the stud 42 is properly positioned, or threaded into the crossbar 32T, the lock nut 44 is threaded onto the stud 42. The lock nut 44 is threaded onto the stud 42 until it contacts the crossbar 32T. The lock nut 44 thereby maintains the positioning of the stud 42 relative to the crossbar 32T. The plurality of studs 42 are similarly secured in each of the comers to either the crossbars 32T, 32B, 34T and 34B or the tabs 46.

Figure 5:
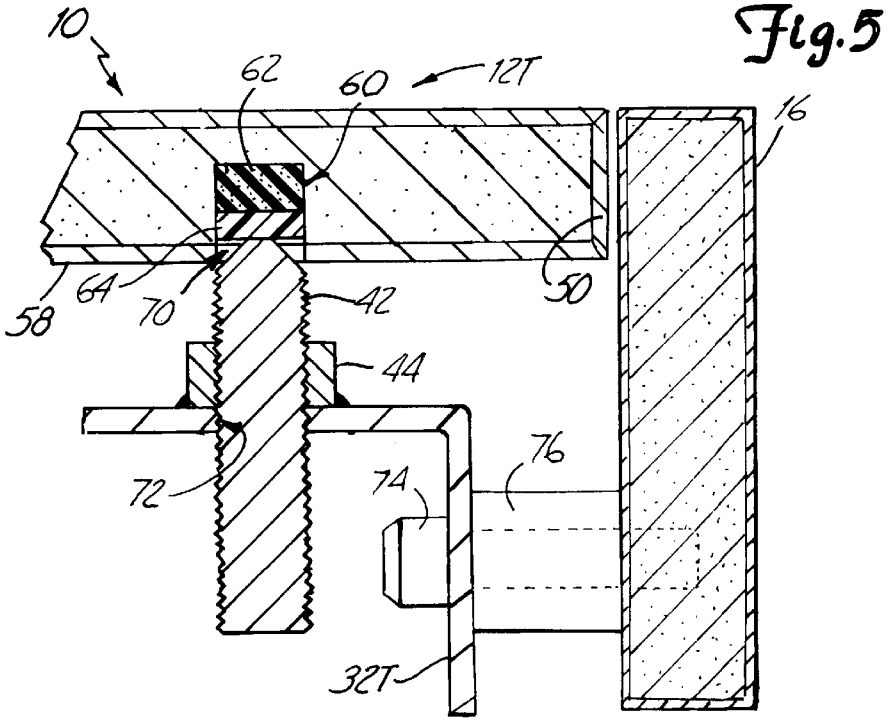
FIG. 5 is a sectional view along a section 5—5 of FIG. 4.

FIG. 5 is a sectional view of a preferred embodiment of the shelving system 10 along section 5—5 shown in FIG. 4. As shown in FIG. 5, the shelf 12T is supported by the stud 42 which contacts the piston 64 capturing the vibration damping material 62 within the cavity 60. The cavity 60 is again bore through the bottom surface 58 of the shelf 12T.

The stud 42 is threadably inserted into the through hole 72 in the top crossbar 32T. Once the stud 42 is properly positioned with respect to the crossbar 32T, the lock nut 44 is threaded over the stud 42 until it contacts the crossbar 32T, securing the stud 42 in place. The tip 70 of the stud 42 then contacts the piston 64 contained within the cavity 60 in the shelf 12T.

The piston 64 has sufficient rigidity to prevent significant deformation when it contacts the pointed tip 70 of the stud 42. Adhesive is preferably applied to the piston 64 to secure the piston 64 to the vibration damping material 62 contained within the cavity 60.

The vibration damping material 62 is captured between the piston 64 and the shelf 12T to absorb vibration or resonance which is able to pass from the tip 70 of the stud 42 to the piston 64. By damping movement of the piston 64, the vibration damping material 62 further limits and prevents vibration or resonance from being transferred to the shelf 12T, and ultimately to the electronic equipment, from the stud 42 secured to the frame 14. Adhesive is preferably applied to secure the damping material 62 to the shelf 12T within the cavity 60. Additionally, by the stud 42 contacting the piston 64 within the cavity 60, the shelf 12T is more stable and is less susceptible to lateral movement about the studs 42.

As illustrated in FIG. 5, the trim plate 16 is secured to the frame 14, and specifically to the top crossbar 32T. The trim plate 16 is secured to the top crossbar 32T by a bolt 74 with a spacer 76 between the trim plate 16 and the top crossbar 32T. A top surface of the trim plate 16 is preferably level with the top surface of the top shelf 12T.

Although the present invention has been described with reference to preferred embodiments, workers skilled in the art will recognize that changes may be made in form and detail without departing from the spirit and scope of the invention. For example, the material used to construct the shelf, the vibration damping material, the piston or the stud can be altered. Further, the vibration damping material, the piston, and the stud can be reversed so that the stud is secured to the shelf and the vibration damping material and piston are in a cavity placed in the frame, such as in the tab or in the crossbar. Also, while the shape of the shelf and frame have been shown as rectangular in the preferred embodiments, other shapes could be used to design the shelving system which requires either more or fewer studs to support each individual shelf. The number of shelves and manner in which the frame is constructed could also be varied. Thus, the shelving system provides improved isolation on a stable support structure for electronic appliances.

What is claimed is:

1. A shelving system for supporting a shelf relative to a frame, the system comprising;

a plurality of studs to support the shelf;

a plurality of cavities, each having a single open end that is aligned with one of the studs;

a piston within each of the cavities to contact an end of the stud; and damping means in each cavity for damping movement of the piston.

2. The system of claim 1, wherein each of the studs has a pointed tip which contacts the piston and supports the shelf.

3. The system of claim 1, wherein the plurality of studs are attached to the frame and extend upward and wherein the plurality of cavities are formed in a bottom surface of the shelf.

4. The system of claim 3, wherein each of the plurality of studs extends above the frame by an adjustable distance.

5. The system of claim 1, wherein the piston is a disc.

6. The system of claim 1, wherein the piston is a polymeric material.

7. The system of claim 1, wherein the damping means is a polymeric damping material.

8. A shelving unit comprising:

a frame;

a shelf; and a shelving system for supporting the shelf relative to the frame, the system comprising:

a plurality of studs;

a plurality of cavities aligned with the studs;

a piston in each cavity to engage an end of one of the studs; and damping means in each cavity for damping movement of the piston.

9. The shelving unit of claim 8, wherein the plurality of studs are threadably received by the frame.

10. The shelving unit of claim 9, and further comprising a plurality of lock nuts for maintaining the position of the studs relative to the frame.

11. The shelving unit of claim 8, wherein each of the plurality of studs extends above the frame by an adjustable distance.

12. The shelving unit of claim 8, wherein each of the plurality of studs has a pointed tip for contacting one of the pistons.

13. The shelving unit of claim 8, wherein each of the plurality of cavities is located in a bottom surface of the shelf.

14. The shelving unit of claim 8, wherein the piston is a disc.

15. The shelving unit of claim 8, wherein the piston is a polymeric material.

16. The shelving unit of claim 8, wherein the damping means is a polymeric damping material.

17. A shelving unit comprising:

a frame;

a plurality of studs projecting upward from the frame;

a shelf having a plurality of cavities in a bottom surface, each cavity being aligned with one of the studs;

a vibration damping material in each cavity; and a piston in each cavity between the vibration damping material and an upper end of one of the studs.

18. The shelving unit of claim 17 and further comprising a plurality of lock nuts for maintaining the position of the plurality of studs relative to the frame.

19. The shelving unit of claim 17, wherein each of the plurality of studs has a pointed tip at its upper end.

20. The shelving unit of claim 17, wherein each of the plurality of studs projects upward from the frame by an adjustable distance.

21. The system of claim 17, wherein the piston is a disc.

22. The system of claim 17, wherein the piston is a polymeric material.

23. The system of claim 17, wherein the damping means is a polymeric damping material.

* * * * *